US008698689B2

(12) United States Patent
Oota et al.

(10) Patent No.: US 8,698,689 B2
(45) Date of Patent: Apr. 15, 2014

(54) MULTI-BEAM ANTENNA DEVICE

(75) Inventors: Masahiko Oota, Chikusei (JP); Taketo Nomura, Chikusei (JP)

(73) Assignee: Hitachi Chemical, Ltd., Tokyo (JP)

( * ) Notice: Subject to any disclaimer, the term of this patent is extended or adjusted under 35 U.S.C. 154(b) by 413 days.

(21) Appl. No.: 13/131,752

(22) PCT Filed: Nov. 30, 2009

(86) PCT No.: PCT/JP2009/070108

§ 371 (c)(1),
(2), (4) Date: May 27, 2011

(87) PCT Pub. No.: WO2010/061948

PCT Pub. Date: Jun. 3, 2010

(65) Prior Publication Data

US 2011/0241968 A1 Oct. 6, 2011

(30) Foreign Application Priority Data

Nov. 28, 2008 (JP) ..... 2008-303781

(51) Int. Cl.
*H01Q 21/00* (2006.01)

(52) U.S. Cl.
USPC ..... 343/853; 343/833

(58) Field of Classification Search
USPC ..... 343/833, 853, 795, 754, 700 MS, 786, 343/783
See application file for complete search history.

(56) References Cited

U.S. PATENT DOCUMENTS 6,480,167 B2 * 11/2002 Matthews ..... 343/795
7,724,197 B1 * 5/2010 Hardie et al. ..... 343/754
2002/0126062 A1 * 9/2002 Matthews ..... 343/795
2011/0285598 A1 * 11/2011 Oota et al. ..... 343/833
2012/0077530 A1 * 3/2012 Wu et al. ..... 455/501
2012/0257653 A1 * 10/2012 Nagaishi et al. ..... 375/219

FOREIGN PATENT DOCUMENTS

| | | |
|---|---|---|
| JP | 56-123105 | 9/1981 |
| JP | 57-093701 | 6/1982 |
| JP | 57-184305 | 11/1982 |
| JP | 2000-124727 | 4/2000 |
| JP | 2003-152422 | 5/2003 |

OTHER PUBLICATIONS

Takashi Katagi et al., An Improved Design Method of Rotman Lens Antennas, IEEE Transactions on Antennas and Propagation, May 1984, pp. 524-527, vol. Ap-32, No. 5.
Jaeheung Kim, et al., Scaling and Focusing of the Rotman Lens, IEEE Antennas and Propagation Society International Symposium, 2001, pp. 773-776, vol. 2.

* cited by examiner

*Primary Examiner* — Thien M Le
(74) *Attorney, Agent, or Firm* — Antonelli, Terry, Stout & Kraus, LLP.

(57) ABSTRACT

A multi-beam antenna suppressing an increase in loss of a Rotman lens to achieve enhanced gain. $\beta<\alpha$, where: $\beta$ is a spatial beam-forming angle of an array antenna viewed from the a front of the antenna; and $\alpha$ is an angle between a center line of a Rotman lens, and a line segment connecting one of the input ports and an intersecting point S2 of the center line with a curve segment having a plurality of output ports A shape of the Rotman lens such that: $\eta=(\beta/\alpha)(Ln/F)<1$, and G is less than when $\beta=\alpha$, where: F is a distance between one input port and S2; 2 Ln is an aperture length of the array antenna; and G is a size of the Rotman lens, defined as a distance between S2 and an intersecting point of the center line with a curve segment having input ports.

19 Claims, 10 Drawing Sheets

MULTI-BEAM ANTENNA DEVICE

TECHNICAL FIELD

The present invention relates to a design method for a Rotman lens usable in a multi-beam antenna device utilizable for millimeter band signal transmitting/receiving.

BACKGROUND ART

To begin with, a conventional antenna device using a Rotman lens will be explained with its top plan view in FIG. 8. In FIG. 8, the reference numeral (1) denotes a Rotman lens. The reference numerals (21),(22), - - - (2*m*) denote respective ones of a plurality of input ports for feeding electric power, and the reference numerals (31),(32), - - - (3*n*) denote respective ones of a plurality of output ports for extracting electric power in the Rotman lens (1). The reference numerals (41),(42), - - - (4*n*) denote respective ones of a plurality of antenna elements for radiating electromagnetic waves to space, and the reference numeral (5) denotes an array antenna having the plurality of antenna elements (41),(42), - - - (4*n*) arranged linearly. The reference numerals (61),(62), - - - (6*n*) denote respective ones of a plurality of transmission lines connecting respective ones of the output ports to respective ones of the antenna elements, and the reference numeral (7) denotes a line section comprised of the transmission lines (61),(62), - - - (6*n*) having different lengths. The reference numeral (8) denotes a center line. This antenna device is line-symmetric with respect to the center line (8). The reference numeral (9) denotes an auxiliary line for indicating a position of one (21) of the input ports. The input port (21) is located in a direction at an elevation angle $\alpha$ with respect to the center line (8) when viewed from S2 which is an origin of an X-Y coordinate system. The reference numeral (10) denotes a straight line which is indicative of a spatial beam direction upon excitation of the input port (21), and oriented in a direction at an angle $\beta$ with respect to a direction facing a front of the array antenna. In a primitive or basic design process, a Rotman lens is generally designed under a condition of $\beta=\alpha$.

In the conventional antenna device configured as above, when one of the input ports (21),(22), - - - (2*m*) is excited, electric power is fed into the Rotman lens (1). The electric power in the Rotman lens (1) is extracted from each of the output ports (31),(32), - - - (3*n*), and transmitted to a corresponding one of the antenna elements (41),(42), - - - (4*n*) through a respective one of the transmission lines (61), (62), - - - (6*n*). An excitation amplitude and an excitation phase of the array antenna (5) are determined by which of the input ports (21),(22), - - - (2*m*) is excited, and the spatial beam direction is determined by the excitation phase of the array antenna (5).

In the conventional antenna device illustrated in FIG. 8, the input ports (21),(22), - - - (2*m*) are arranged on an arc having a radius R from a center located at a focal point S1 of the Rotman lens. The origin S2 of the X-Y coordinate system is represented by an intersecting point of the center line (8) with a curve segment having the output ports (31), (32), - - - , (3*n*) arranged thereon. S3 indicates an intersecting point of the center line (8) with a curve segment having the input ports (21), (22), - - - , (2*m*) arranged thereon. An x coordinate and a y coordinate of each of the output ports (31),(32), - - - (3*n*), and an electrical length w of each of the transmission lines (61),(62), - - - (6*n*), are expressed in the following Formulas 1 to 3, respectively:

$$x=[2w(1-g)-b_0^2\eta^2]/2(g-a_0) \quad (1)$$

$$y=\eta(1-w) \quad (2)$$

$$w=[-b-\sqrt{(b^2-4ac)}]/2a \quad (3)$$

In the above Formulas 1 to 3, $g=G/F, \eta=Ln/F, a_0=\cos\alpha, b_0=\sin\alpha,$ $a=1-\eta^2-[(g-1)/(g-a_0)]^2,$ $b=2g(g-1)/(g-a_0)-[(g-1)/(g-a_0)^2]b_0^2\eta^2+2\eta^2-2g$, and $c=gb_0^2\eta^2/(g-a_0)-b_0^4\eta^4/[4(g-a_0)^2]-\eta^2.$ Further, the radius R is expressed in the following formula:

$$R=[(Fa_0-G)^2+F^2+b_0^2]/[2(G-Fa_0)] \quad (4)$$

In the Formula 4, G is a size of the Rotman lens defined by a distance between S2 and S3. Further, F is a distance between the input port (21) and S2, and 2 Ln is an aperture length of the array antenna (5). In the basic design process, it is commonly considered that it is desirable to set approximately in the following range: $0.8<\eta<1$, i.e., set F in a range of about 1 to 1.25 times Ln, and set g to about 1.137, under a defined condition of $\beta=\alpha$, in view of an advantage of being able to reduce an error in excitation phase at each of the output ports (31), (32), - - - (3*n*).

PRIOR ART DOCUMENTS

Patent Documents

Patent Document 1: JP 57-93701A
Patent Document 2: JP 57-184305A
Patent Document 3: JP 56-123105A
Patent Document 4: JP 2000-124727A

DISCLOSURE OF THE INVENTION

Problem to be Solved by the Invention

However, in the conventional antenna device illustrated in FIG. 8, as a prerequisite to allowing the line section (7) to be configured, the radicand inside the radical symbol in the Formula 3 is required to have a positive sign or to be zero. In other words, the following Formula 5 has to be satisfied.

$$b^2-4ac\geq 0 \quad (5)$$

As a prerequisite to satisfying the Formula 5, $\eta=Ln/F$ has to be equal to or less than 1 ($\eta=Ln/F\leq 1$). This means that, in cases where the aperture 2 Ln of the array antenna (5) becomes larger due to an increase in the number of the antenna elements (41),(42), - - - (4*n*), it is necessary to increase the distance F between the input port (21) and S2 in proportion to the aperture 2 Ln of the array antenna (5), resulting in an increase in the size G of the Rotman lens. Therefore, when the number of the antenna elements (41), (42), - - - (4*n*) is increased, it is necessary to increase the size G of the Rotman lens in conformity to an increasing rate of the antenna elements, which causes a problem that, even though the number of the antenna elements is increased, an appropriate gain enhancement effect cannot be obtained.

The present invention is directed to providing a low-loss multi-beam antenna device capable of, under a condition that $\beta$ with respect to $\alpha$ is set to satisfy the following relation: $\beta<\alpha$, where: $\beta$ is a spatial beam-forming angle of an array antenna (5); and $\alpha$ is an angle between a center line (8) and a line segment which connects one of a plurality of input ports and an intersecting point S2 of the center line (8) with a curve segment having a plurality of output ports (31), (32), - - - , (3*n*) arranged thereon, reducing G which is a size of a Rotman lens, to less than a value of G set out through a basic design process, i.e., a basic value of G when designed under a defined condition of $\beta=\alpha$, and thereby suppressing an increase in loss of the Rotman lens so as to achieve enhanced gain.

Means for Solving the Problem

A multi-beam antenna of the present invention is characterized in that, under a condition that $\beta$ with respect to $\alpha$ is set to satisfy the following relation: $\beta<\alpha$, where: $\beta$ is a spatial beam-forming angle of an array antenna; and $\alpha$ is an angle between a center line (8), and a line segment which connects one of a plurality of input ports and an intersecting point S2 of the center line (8) with a curve segment having a plurality of output ports (31), (32), - - - , (3*n*) arranged thereon, a shape of a Rotman lens is set to satisfy the following relation: $\eta=(\beta/\alpha)\cdot(Ln/F)<1$ (Formula 6), and reduce G to less than a basic value of G when designed under a defined condition of $\beta=\alpha$, where: F is a distance between the one input port (21) and S2; 2 Ln is an aperture length of the array antenna (5); and G is a size of the Rotman lens, and defined as a distance between S2 and S3 (wherein S3 is an intersecting point of the center line (8) with a curve segment having the input ports (21), (22), - - - , (2*m*) arranged thereon).

In one embodiment of the present invention, the multi-beam antenna device is further characterized in that the Rotman lens is formed using a triplate.

In one embodiment of the present invention, the multi-beam antenna device is further characterized in that the array antenna is formed using a triplate.

In one embodiment of the present invention, the multi-beam antenna device is further characterized in that each of the input ports is partially formed as two branched transmission lines to distribute and feed electric power.

In another aspect, a multi-beam antenna device of the present invention comprises: a Rotman lens having a plurality of input ports (21), (22), - - - , (2*m*) for feeding electric power, and a plurality of output ports (31), (32), - - - , (3*n*) for extracting the electric power from the input ports; an array antenna comprised of a plurality of antenna elements and adapted to radiate electromagnetic waves to space; and a plurality of transmission lines connecting respective ones of the output ports to respective ones of the antenna elements, wherein a curve for arranging the output ports thereon and a length of each of the transmission lines are set such that, when a given one of the input ports is excited, a beam is formed in a direction at an angle corresponding to that of the given input port. The multi-beam antenna device is characterized in that: $\beta$ with respect to $\alpha$ is set to satisfy the following relation: $\beta<\alpha$, where: $\beta$ is a spatial beam-forming angle of the array antenna when viewed from a direction facing a front of the array antenna; and $\alpha$ is an angle between a center line (8) of the Rotman lens, and a line segment which connects one of the input ports and an intersecting point S2 of the center line (8) with a curve segment having the output ports (31), (32), - - - , (3*n*) arranged thereon; and a shape of the Rotman lens is set to reduce G to less than a value of G when designed under a condition of $\beta=\alpha$, where G is a size of the Rotman lens, and defined as a distance between S2 and S3 (wherein S3 is an intersecting point of the center line (8) with a curve segment having the input ports (21), (22), - - - , (2*m*) arranged thereon).

In yet another aspect, a multi-beam antenna device of the present invention comprises: a Rotman lens having a plurality of input ports (21), (22), - - - , (2*m*) for feeding electric power, and a plurality of output ports (31), (32), - - - , (3*n*) for extracting the electric power from the input ports; an array antenna comprised of a plurality of antenna elements and adapted to radiate electromagnetic waves to space; and a plurality of transmission lines connecting respective ones of the output ports to respective ones of the antenna elements, wherein a curve for arranging the output ports thereon and a length of each of the transmission lines are set such that, when a given one of the input ports is excited, a beam is formed in a direction at an angle corresponding to that of the given input port. The multi-beam antenna device is characterized in that the Rotman lens is designed according to a design procedure comprising the steps of: setting a number n of element arrays of the input or output ports; setting an arrangement pitch P of the element arrays; setting a beam number and a beam step angle; setting $\beta$ with respect to $\alpha$ to satisfy the following relation: $\beta<\alpha$, where: $\beta$ is a spatial beam-forming angle of the array antenna when viewed from a direction facing a front of the array antenna; and $\alpha$ is an angle between a center line (8) of the Rotman lens, and a line segment which connects one of the input ports and an intersecting point S2 of the center line (8) with a curve segment having the output ports (31), (32), - - - , (3*n*) arranged thereon; calculating Fx which allows $b^2-4ac=0$; setting a value of F; setting a value of G; and calculating respective coordinates (x, y) of the output ports of a number N corresponding to the number n of the element arrays, and a corrective line phase w in each of the output ports, whereby a shape of the Rotman lens is set to reduce G to less than a value of G when designed under a condition of $\beta=\alpha$, where G is a size of the Rotman lens, and defined as a distance between S2 and S3 (wherein S3 is an intersecting point of the center line (8) with a curve segment having the input ports (21), (22), - - - , (2*m*) arranged thereon). In the multi-beam antenna device, $$a=1-\eta^2-[(g-1)/(g-a_0)]^2,$$

$$b=2g(g-1)/(g-a_0)-[(g-1)/(g-a_0)^2]b_0^2\eta^2+2\eta^2-2g, \text{ and}$$

$$c=gb_0^2\eta^2/(g-a_0)-b_0^4\eta^4/[4(g-a_0)^2]\eta^2,$$

where $g=G/F$, $\eta=(\beta/\alpha)\cdot(Ln/F)$, $a_0=\cos\alpha$, and $b_0=\sin\alpha$.

In still another aspect, an in-vehicle multi-beam antenna device of the present invention comprises: a Rotman lens having a plurality of input ports (21), (22), - - - , (2*m*) for feeding electric power, and a plurality of output ports (31), (32), - - - , (3*n*) for extracting the electric power from the input ports; an array antenna comprised of a plurality of antenna elements and each adapted to radiate electromagnetic waves to space; and a plurality of transmission lines connecting respective ones of the output ports to respective ones of the antenna elements, wherein a curve for arranging the output ports thereon and a length of each of the transmission lines are set such that, when a given one of the input ports is excited, a beam is formed in a direction at an angle corresponding to that of the given input port. The multi-beam antenna device is characterized in that $\beta$ with respect to $\alpha$ is set to satisfy the following relation: $\beta<\alpha$, where: $\beta$ is a spatial beam-forming angle of the array antenna when viewed from a direction facing a front of the array antenna; and $\alpha$ is an angle between a center line (8) of the Rotman lens, and a line segment which connects one of the input ports and an intersecting point S2 of the center line (8) with a curve segment having the output ports (31), (32), - - - , (3*n*) arranged thereon.

Effect of the Invention

The present invention can provide a low-loss multi-beam antenna device which is capable of, under a condition that $\beta$ with respect to α is set to satisfy the following relation: β<α, where: β is a spatial beam-forming angle of an array antenna (5); and α is an angle between a center line (8) and a line segment which connects one of a plurality of input ports and an intersecting point S2 of the center line (8) with a curve segment having a plurality of output ports (31), (32), - - - , (3*n*) arranged thereon, reducing G which is a size of a Rotman lens, to less than a basic value of G when designed under a defined condition of β=α, and thereby suppressing an increase in loss of the Rotman lens so as to achieve enhanced gain.

DESCRIPTION OF EMBODIMENTS

First Embodiment

Figure 1:
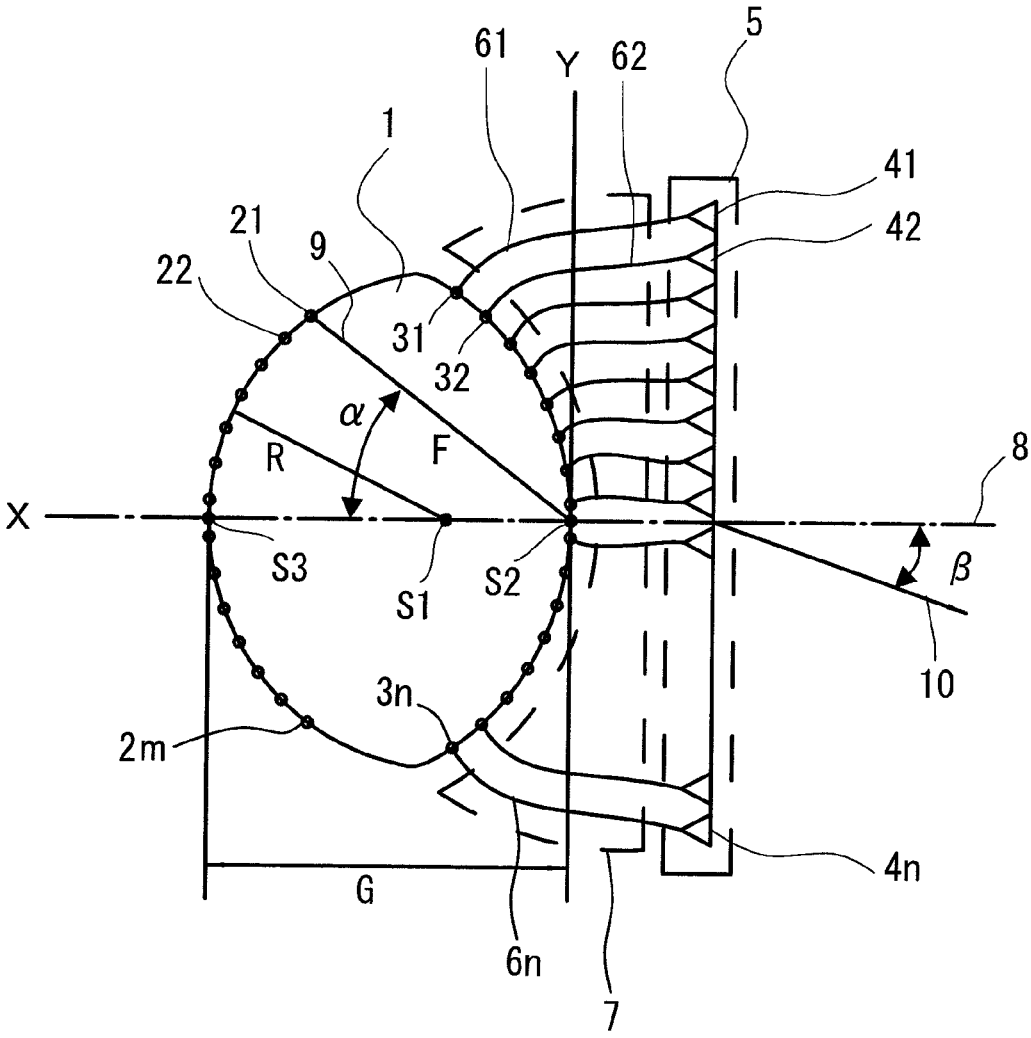
FIG. 1 is an explanatory diagram illustrating a configuration of a multi-beam antenna device according to the present invention.

A multi-beam antenna according to the present invention is characterized in that, under a condition that β with respect to α is set to satisfy the following relation: β<α, where: β is a spatial beam-forming angle of an array antenna (5); and α is an elevation angle between a center line (8), and a line segment which connects one of a plurality of input ports and an intersecting point S2 of the center line (8) with a curve segment having a plurality of output ports (31), (32), - - - , (3*n*) arranged thereon, a shape of a Rotman lens is set to satisfy the Formula 6, and reduce G to less than a basic value of G when designed under a defined condition of β=α, where: F is a distance between the one input port (21) and S2; G is a size of the Rotman lens, and defined as a distance between S2 and S3; and 2 Ln is an aperture length of the array antenna (5).

Specifically, in cases where a Rotman lens is designed under the defined condition of β=α, as a prerequisite to satisfying the Formula 5, η=Ln/F has to be equal to or less than 1 (η=Ln/F≤1). Further, it is generally considered that it is desirable to set η approximately in the following range: 0.8<η<1, i.e., set F in a range of about 1 to 1.25 times Ln, and set g to about 1.137, in view of an advantage of being able to reduce an error in excitation phase at each of the output ports (31), (32), - - - (3*n*). Thus, it is preferable to set F and G in the following respective ranges with respect to Ln:

$$Ln<F<1.25Ln, 1.137Ln<G<1.42Ln$$

Moreover, if the aperture 2 Ln of the array antenna (5) becomes larger due to an increase in the number of the antenna elements (41),(42), - - - (4*n*), the distance F between the input port (21) and S2 is increased in proportion to 2 Ln, resulting in an increase in the basic value of G.

Differently, in the present invention, for example, assuming that β=α/2, as a prerequisite to satisfying the Formula 5, η=Ln /2 F has to be equal to or less than 1 (η=Ln/2F≤1), and it is desirable to set F in a range of about 0.5 to 0.625 times Ln, and set g to about 1.137, in view of an advantage of being able to reduce an error in excitation phase at each of the output ports (31), (32), - - - (3*n*). Thus, desirable design can be achieved when F and G are set in the following respective ranges with respect to Ln:

$$0.5Ln<F<0.625Ln, 0.568Ln<G<0.71Ln$$

In this case, the Rotman lens can be designed to have a size which is ½ times a basic value of G when designed under the defined condition of β=α.

Figure 7:
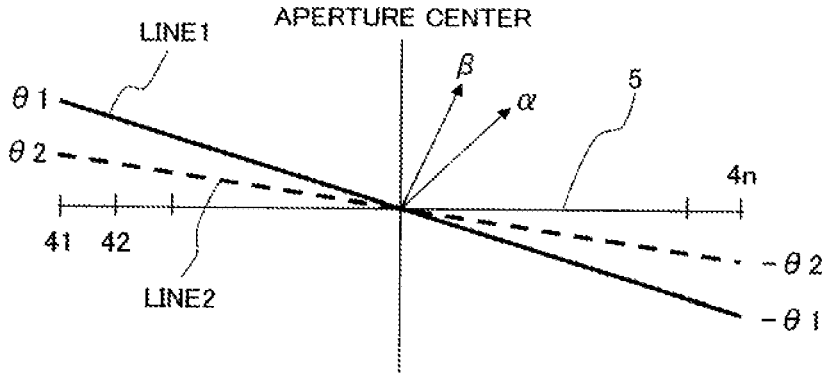
FIG. 7 is an explanatory diagram illustrating a phase inclination in an array antenna aperture plane depending on a given input port of a multi-beam antenna device according to the present invention.
Figure 8:
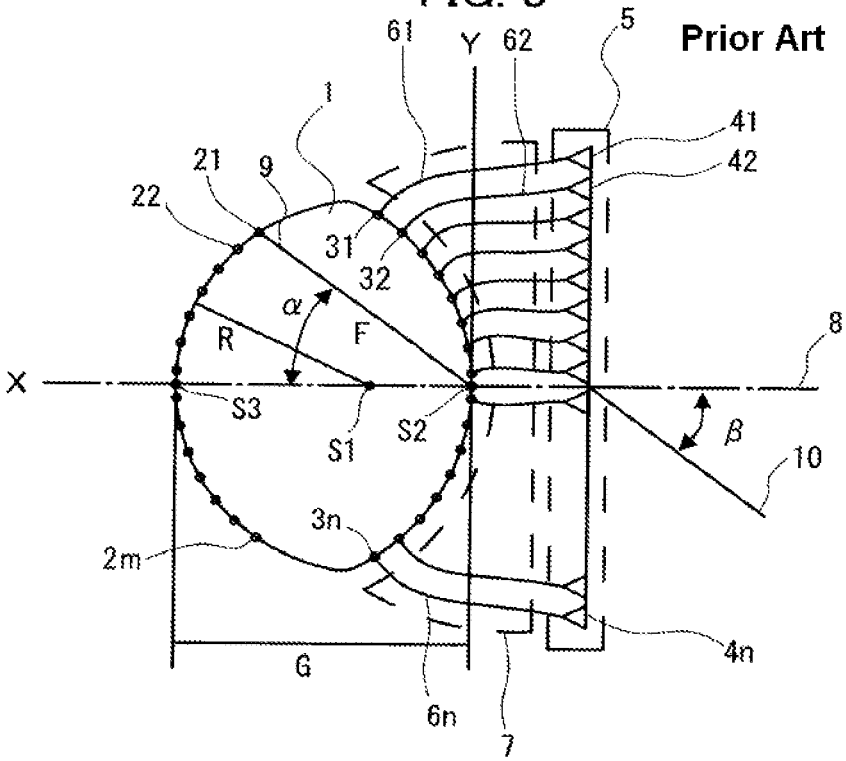
FIG. 8 is an explanatory diagram illustrating a configuration of an example of a conventional multi-beam antenna device.

In addition, in the multi-beam antenna of the present invention which is designed based on respective coordinates (x, y) of the output ports (31), (32), - - - , (3*n*) and respective electrical lengths w of the transmission lines (61),(62), - - - (6*n*), each calculated using the Formulas 1 to 4, when electric power is fed from a given one of the input ports which has an angle α when viewed from S2, a phase inclination of a line representing respective excitation phases at the antenna elements (41),(42), - - - (4*n*) on the basis of that at an aperture center of the array antenna (5), as indicated by the straight line 2 in FIG. 7, is reduced by one-half as compared with the straight line 1 in FIG. 7 which represents respective excitation phases at the antenna elements (41),(42), - - - (4*n*) of the basic multi-beam antenna designed under the defined condition of β=a, and a spatial beam-forming direction β of the array antenna (5) is reduced to one-half of a spatial beam-forming direction α of the array antenna (5) in the basic multi-beam antenna designed under the defined condition of β=α.

Thus, in the present invention, under the condition of β<α, a shape of the Rotman lens is set to satisfy the relation of the Formula 6, so that it becomes possible to design a small-sized Rotman lens having a size which is β/α times a basic value of G when designed under the defined condition of β=α. This makes it possible to suppress an increase in loss of the Rotman lens which would otherwise occur in proportion to a size thereof. In addition, even if the aperture 2 Ln of the array antenna (5) becomes larger due to an increase in the number of the antenna elements (41),(42), - - - (4*n*), and thereby the distance F between the input port (21) and S2 is increased in proportion to 2 Ln, a small-sized Rotman lens having a size reduced to $\beta/\alpha$ times the basic value of G when designed under the defined condition of $\beta<\alpha$ can be designed so as to make up a multi-beam antenna device having a spatial beam-forming direction $\beta$ of the array antenna (5).

Figure 2:
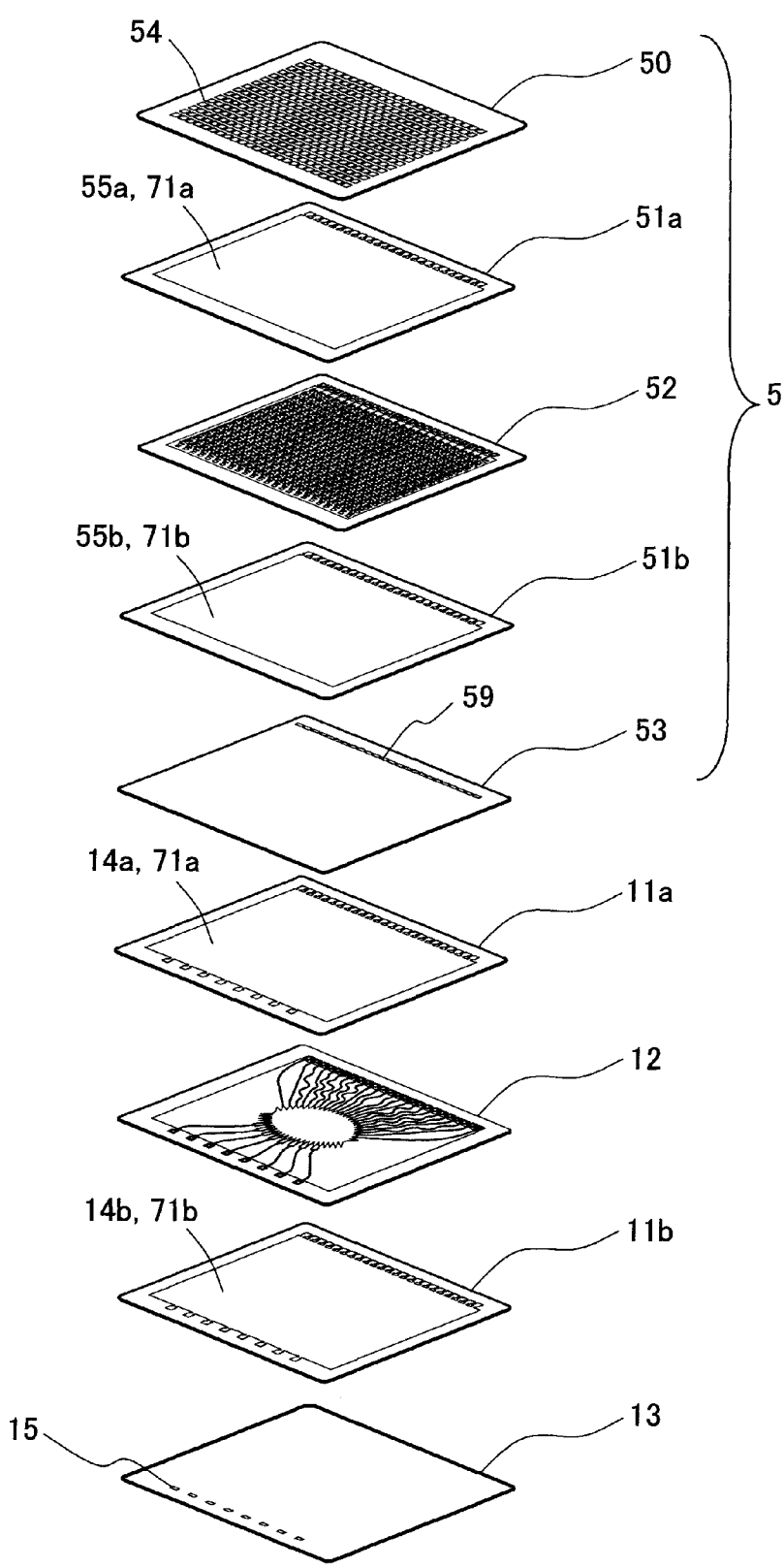
FIG. 2 is an explanatory diagram perspectively illustrating a structure of a multi-beam antenna device according to the present invention.

As shown in FIG. 2, in a multi-beam antenna device according to a first embodiment of the present invention, the Rotman lens may be formed in a triplate structure. In this case, a taper shape in complicated input and output port sections, and a phase-adjusting transmission line section (7), can be easily formed by means of etching or the like, and a first connection section (58) of the array antenna (5) and a connection port sub-section (16) of the transmission line section (7) can be electromagnetically coupled together via a first connection hole (59) provided in a first ground conductor (53). Further, in the multi-beam antenna device according to the first embodiment, the antenna array may also be formed in a triplate structure. In this case, it becomes possible to make up a low-loss multi-beam antenna device with a simple laminated structure of all components thereof. Specifically, the array antenna in the multi-beam antenna device according to the first embodiment is formed as a triplate-structured array antenna by laminating a slotted plate (50) and a feeder line (57) of an antenna substrate (52), and the first ground conductor (53) together through a dielectric (71*a*, 71*b*) interposed between adjacent ones thereof. Based on employing this structure, it becomes possible to make up a low-loss multi-beam antenna device with a simple laminated structure of all components thereof.

The above description has been made on an assumption that the present invention is applied to a commonly-used hollow parallel-plate Rotman lens, or a triplate structure in which a Rotman lens substrate (12) is supported by a dielectric having a low approximately equal to that of air. In a parallel plate or a triplate structure using a dielectric having a relative permittivity $\in r$, it is apparent that the Formula 6 in the present invention may be handled as the following Formula 7.

$$\eta=(1/\sqrt{\in r})\cdot(\beta/\alpha)\cdot(Ln/F)<1 \quad (7)$$

Figure 3:
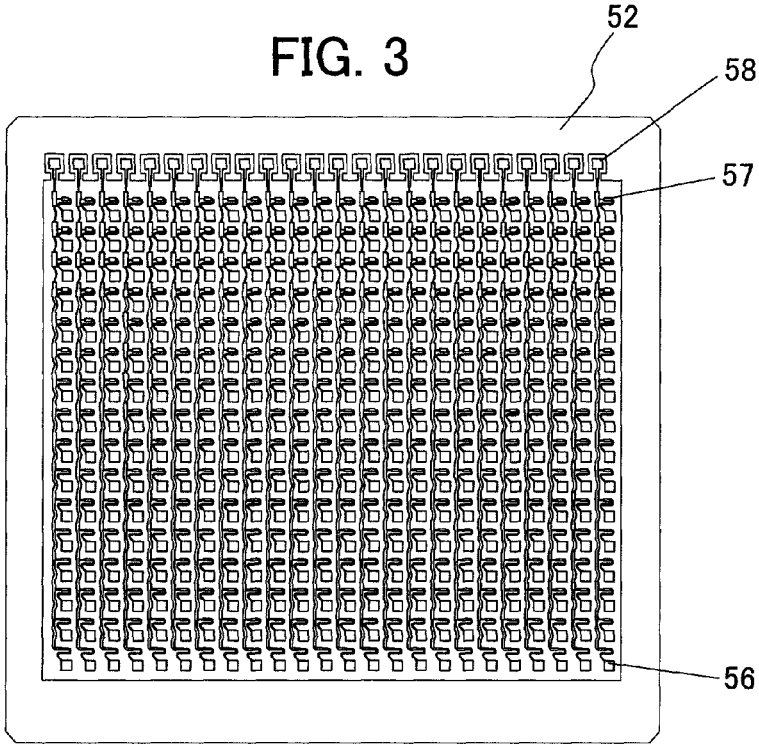
FIG. 3 is an explanatory diagram illustrating a planar structure of an antenna substrate of a multi-beam antenna device according to the present invention.

In the multi-beam antenna device according to the first embodiment, a radiation element (56) formed in the antenna substrate (52) illustrated in FIG. 3 can radiate an electromagnetic wave having a desired frequency in cooperation with the first ground conductor (53) and a slot (54) formed in the slot plate (50), illustrated in FIG. 2, to serve as the antenna element. A plurality of the antenna elements are arranged to form the array antenna (5) as a whole. Further, a triplate-structured Rotman lens is made up of the first ground conductor (53), the Rotman lens substrate (12) and a second ground conductor (13), illustrated in FIG. 2. More specifically, as illustrated in FIG. 2, the triplate-structured Rotman lens is formed by laminating the first ground conductor (53), the transmission line section (7) of the Rotman lens substrate (12), and the second ground conductor (13) together through a dielectric (71*a*, 71*b*) interposed between adjacent ones thereof.

Figure 4:
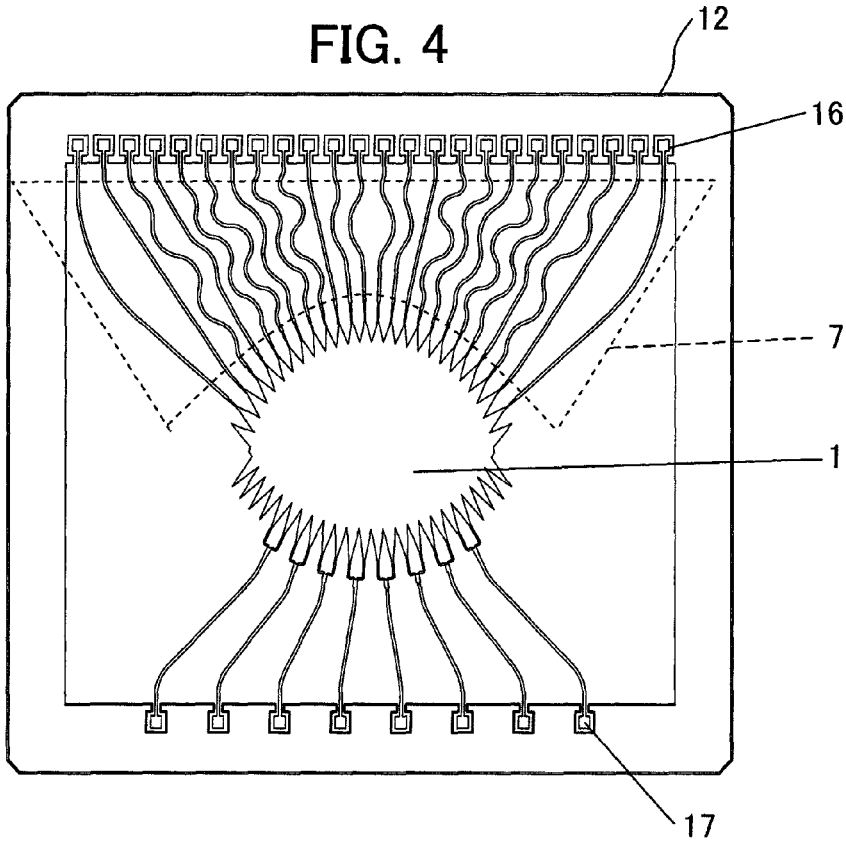
FIG. 4 is an explanatory diagram illustrating a planar structure of a Rotman lens substrate of a multi-beam antenna device according to the present invention.

The first connection section (58) formed in the antenna substrate (52) is electromagnetically coupled with the connection port sub-section (16) of the transmission line section (7) formed in the Rotman lens substrate (12) illustrated in FIG. 4, through the first connection hole (59) formed in the first ground conductor (53), so that desired exciting electric power is transmitted from the output ports of the Rotman lens (1) to the array antenna (5).

In this process, each of a metal spacer (51*a*, 51*b*) disposed on a respective one of upper and lower sides of the antenna substrate (52) and a metal spacer (11*a*, 11*b*) disposed a respective one of upper and lower sides of the Rotman lens substrate (12) holds a respective one of the antenna substrate (52) and the Rotman lens substrate (12) in a spaced manner, while forming a metal wall around an electromagnetic coupling region between the first connection section (58) formed in the antenna substrate (52) and the connection port sub-section (16) of the transmission line section (7) formed in the Rotman lens substrate (12), so that they can contribute to efficient transmission of electric power without leakage to the surroundings, so as to achieve low-loss characteristics even at high frequencies.

In order to stably hold the antenna substrate (52) and the Rotman lens substrate (12), each of a void (55*a*, 55*b*) in the metal spacer (51*a*, 51*b*) and a void (14*a*, 14*b*) in the metal spacers (11*a*, 11*a*) may be filled with a dielectric (71*a*, 71*b*).

The metal spacer (11*a*, 11*b*) also forms a metal wall around the input port section (17) of the antenna device, so that it can contribute to efficient transmission of electric power to a high-frequency circuit through a second connection hole (15) formed in the second ground conductor (13) without leakage to the surroundings, so as to achieve low-loss characteristics even at high frequencies.

Each of the first connection hole (59) and the second connection hole (15) may be formed as a waveguide opening suited to a frequency band to be used.

In addition, based on the simple laminated structure of the components, transmission/receiving of electric power is performed by means of electromagnetic coupling, so that it is not necessary to ensure high positional accuracy during assembly at a level of conventional assembly accuracy.

Preferably, in the multi-beam antenna device according to the first embodiment, as each of the antenna substrate (52) and the Rotman lens substrate (12), a flexible substrate prepared by laminating a polyimide film to a copper foil is employed, wherein the radiation element (56), the feeder line (57), the first connection section (58), the Rotman lens (1), the transmission line section (7), the connection port sub-section (16) of the transmission line section (7), and the input port section (17) of the antenna device, are formed by etchingly removing an unnecessary part of the copper foil.

The flexible substrate may be prepared by employing a film as a base material and laminating a metal foil, such as a copper foil, onto the film. In this case, the radiation elements and a plurality of the feeder lines connecting therebetween may be formed by etchingly removing an unnecessary part of the copper foil (metal foil). Alternatively, the flexible substrate may be made up using a copper-cladded laminate prepared by laminating a copper foil on a thin resin sheet consisting of a glass cloth impregnated with resin. The film may be made of a material, such as polyethylene, polypropylene, polytetrafluoroethylene, ethylene fluoride-polypropylene copolymer, ethylene-tetrafluoroethylene copolymer, polyamide, polyimide, polyamide-imide, polyarylate, thermoplastic polyimide, polyetherimide, polyether ether ketone, polyethylene terephthalate, polybutylene terephthalate, polystyrene, polysulfone, polyphenylene ether, polyphenylene sulfide, or polymethylpentene. An adhesive may be used for lamination between the film and the metal foil. In view of thermal resistance, dielectric characteristics and versatility, it is preferable to use a flexible substrate prepared by laminating a polyimide film to a copper foil. In view of dielectric characteristics, a fluorine-based film is preferably used.

As the ground conductor or the metal spacer for use in the multi-beam antenna device according to the first embodiment, a metal plate or a coated plastic plate may be used. Particularly, it is preferable to use an aluminum plate in view of an advantage of being able to produce the ground conductor or the metal spacer in a low weight and at a low cost. Alternatively, the ground conductor or the metal spacer may be made up using a flexible substrate prepared by employing a film as a base material and laminating a copper foil onto the film, or a copper-cladded laminate prepared by laminating a copper foil on a thin resin sheet consisting of a glass cloth impregnated with resin. A slot or coupling hole-forming section formed in the ground conductor may be formed by punching based on mechanical press or by etching. In view of simplicity, productivity, etc., the punching based on mechanical press is preferable.

For example, as the substrate-supporting dielectric (71*a*, 71*b*) for use in the multi-beam antenna device according to the first embodiment, it is preferable to use a foamed material having a small relative permittivity with respect to air. The foamed material may include: a polyolefin-based foamed material such as polyethylene or polypropylene; a polystyrene-based foamed material; a polyurethane-based foamed material; a polysilicone-based foamed material; and a rubber-based foamed material. Among them, a polyolefin-based foamed material is preferable, because it is lower in the relative permittivity with respect to air.

Second Embodiment

The multi-beam antenna device according to the first embodiment will be further viewed in terms of dimensions of each member, etc., and described as a second embodiment with reference to FIG. 2. Each of the slotted plate (50), the first ground conductor (53), the second ground conductor (13), the metal spacer (51*a*, 51*b*), and the metal spacer (11*a*, 11*b*), is made up using an aluminum plate having a thickness of 0.3 mm. Further, the substrate-supporting dielectric (71*a*, 71*b*) is made up using a polyethylene foam having a thickness of 0.3 mm and a relative permittivity of about 1.1. Each of the antenna substrate (52) and the Rotman lens substrate (12) is made up using a flexible substrate prepared by laminating a copper foil (having a thickness, for example, of 25 μm) to a polyimide film (having a thickness, for example, of 25 μm), wherein the radiation element (56), the feeder line (57), the first connection section (58), the Rotman lens (1), the transmission line section (7), the connection port sub-section (16) of the transmission line section (7), and the input port section (17), are formed by etchingly removing an unnecessary part of the copper foil. Each of all of the ground conductors, the slotted plate and all of the metal spacers, is made up using an aluminum plate subjected to punching based on mechanical press.

In this process, each of the radiation elements (41) is formed in a square shape having a side length of 1.5 mm which is about 0.38 times a free space wavelength (λo=3.95 mm) at a frequency of 76 GHz. Further, the slot (54) formed in the slotted plate (50) is formed in a square shape having a side length of 2.3 mm which is about 0.58 times the free space wavelength (λo=3.95 mm) at the desired frequency of 76 GHz, and each of the first connection hole (59) formed in the first ground conductor (53) and the second connection hole (15) formed in the second ground conductor (13) is formed as a waveguide opening having a size of 1.25 mm length×2.53 mm width. Twenty four antenna element arrays each made up of the radiation elements (56) formed in the antenna substrate (52) illustrated in FIG. 3, the first ground conductor (53) illustrated in FIG. 2, the slots (54) formed in the slotted plate (50), and the feeder lines (57), are arranged at a pitch of 3.0 mm which is about 0.77 times the free space wavelength (λo=3.95 mm) at the desired frequency of 76 GHz, to form an array antenna (5) having an antenna aperture 2 Ln of 24×0.77 λo as a whole. A side length is set to 2.3 mm which is about 0.58 times the free space wavelength (λo=3.95 mm) at the desired frequency of 76 GHz.

Further, the Rotman lens (1) having the 24 output ports to be formed in the Rotman lens substrate (12) illustrated in FIG. 4 is designed based on respective coordinates (x, y) of the output ports and respective electrical lengths w of the transmission lines calculated using the Formulas 1 to 4 on an assumption that F=5 λo, and G=5.7 λo, in the following range: 0.568 Ln<G<0.71 Ln, while satisfying the Formula 6 wherein β=α/2, i.e., a condition of η=(½)·(Ln/F)<1. Specifically, the size G of the Rotman lens (1) is set to a value which is about 5.7 times the free space wavelength (λo=3.95 mm) at the desired frequency of 76 GHz, i.e., to 22.5 mm.

Figure 6:
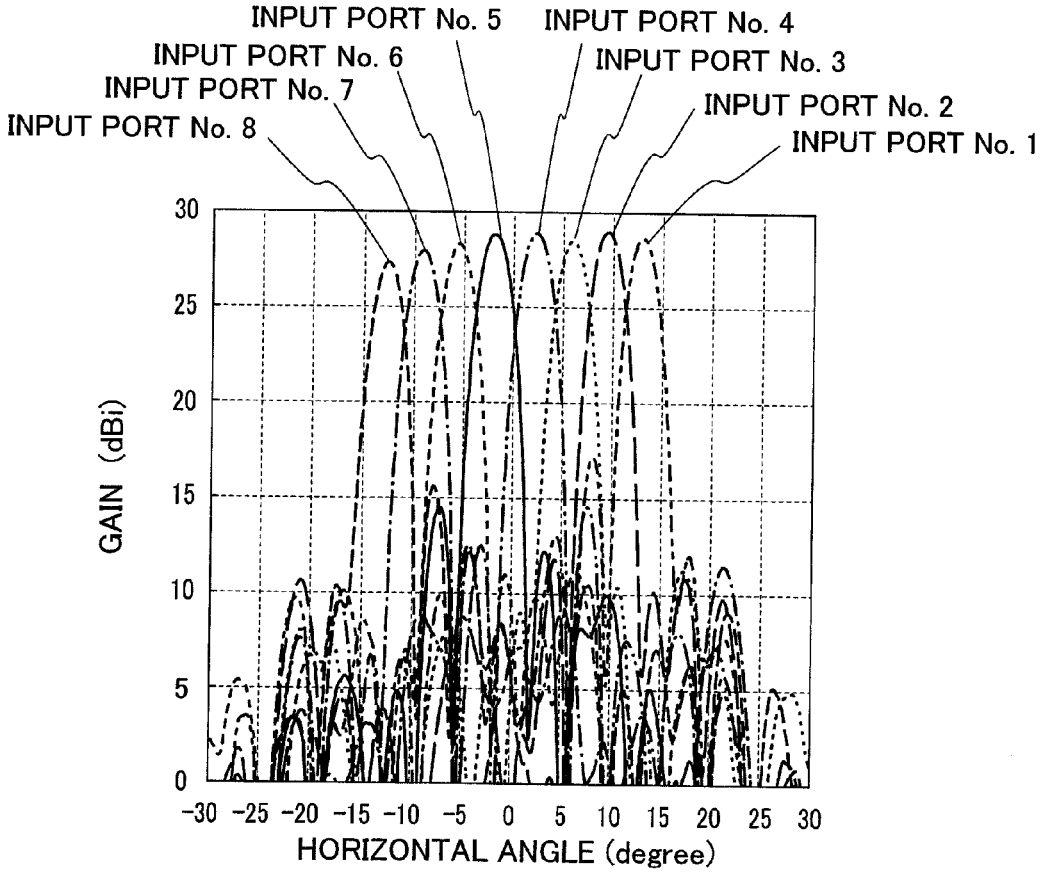
FIG. 6 is an explanatory diagram illustrating directivity characteristics of a multi-beam antenna device according to the present invention.

The above members were actually laminated in order as illustrated in FIG. 2 to make up a multi-beam antenna device, and a measurement unit was connected to the multi-beam antenna device to measure characteristics thereof. As a result, a reflectance loss of each of the following eight input ports was equal to or less than—15 dB, and a gain directionality corresponding to each of the eight input ports was obtained as shown in FIG. 6. Further, it could be ascertained that a beam of the array antenna (5) can be formed in a direction at an angle β which is about one-half of an input port angle α, as shown in Table 1. In this case, an insertion loss of the Rotman lens (1) having the size G=22.5 mm was about 2.5 dB.

TABLE 1

| Input Port No. | Input Port Angle α (degree) | Antenna Beam Angle β (degree) |
|---|---|---|
| 1 | 26 | 13.0 |
| 2 | 19 | 9.4 |
| 3 | 12 | 5.9 |
| 4 | 5 | 2.3 |
| 5 | −5 | −2.0 |
| 6 | −12 | −5.5 |
| 7 | −19 | −9.2 |
| 8 | −26 | −12.7 |

On the other hand, in a conventional Rotman lens designed in the following range: 1.137 Ln<G<1.42 Ln, while satisfying the condition of the Formula 5 under the defined condition of β=α, i.e., =Ln/F<1, it is at least necessary that G=1.137, Ln=10.5 λo, so that the size G of the conventional Rotman lens is set to a value which is about 10.5 times the free space wavelength λo=3.95 mm) at the desired frequency of 76 GHz, i.e., to 41.5 mm. In this case, an insertion loss of the Rotman lens (1) was about 5 dB.

As above, the multi-beam antenna device according to the second embodiment is improved in relative gain by 2.5 dB or more, in comparison on the basis of a loss in a multi-beam antenna device formed by the conventional design process, so that it can achieve excellent characteristics.

Third Embodiment

Figure 5:
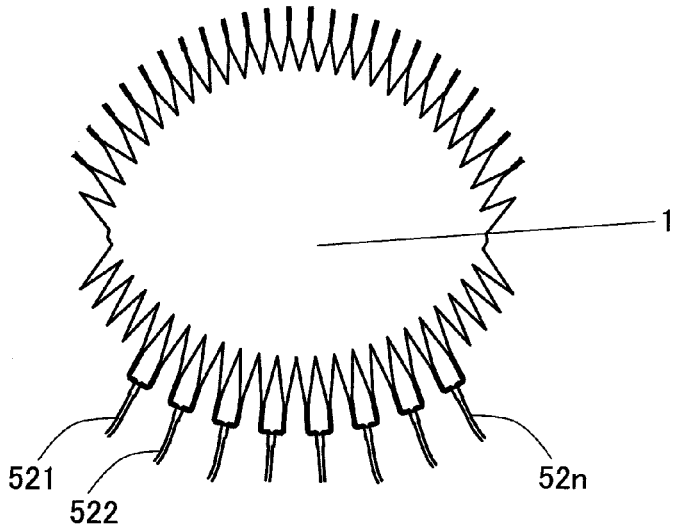
FIG. 5 is an explanatory diagram illustrating a power feeding system at input ports of a Rotman lens of a multi-beam antenna device according to the present invention.

In a multi-beam antenna device according to a third embodiment, as shown in FIG. 5, a connection portion of each of a plurality of input ports (521),(522), - - - (52*m*) is formed as a two branched transmission lines to distribute and feed electric power, which allows the electric power fed from the input ports into a Rotman lens (1) to be concentrated in a central region of a plurality of output ports (531),(532), - - - (53*n*), so as to suppress dispersion of the electric power toward a region devoid of the output ports (531),(532), - - - (53*n*) in a curve segment having the output ports arranged thereon. This makes it possible to reduce an unnecessary internal reflection component to suppress deterioration in sidelobe characteristics of radiation beams of an array antenna (5). Particularly, when electric power is input from an input port, such as the input port (521) or the input port (52*n*), located at an end of the curve segment having the input ports arranged thereon, electric power may be fed while setting a phase difference between the two branched transmission lines of the connection portion. This makes it possible to control a propagation direction of the electric power fed into the Rotman lens (1) in such a manner as to concentrate the electric power in the central region of the output ports (531), (532), - - - (53*n*), to suppress deterioration in sidelobe characteristics of radiation beams of the array antenna (5). The above function never impairs the advantageous effects as shown in FIG. 6 but rather generates a synergistic effect.

(Supplementary Explanation about Objects and Effects of the Present Invention and Objects and Effects of Conventional Techniques)

As mentioned in the "Background Art", design of a lens based on the Rotman's concept is generally performed under the condition of $\beta=60$. One feature of the present invention is that the present invention makes it possible to design a Rotman lens under the condition of $\beta<\alpha$, using the aforementioned modified Rotman process based on the conventional Rotman lens design process. Specifically, under the condition of $\beta<\alpha$, $\beta$ (radiation angle on the side of the antenna elements) is less than a (beam angle on the side of the Rotman lens). Thus, the present invention is effective, particularly, when it a high resolution is required with respect to a narrow angle. For example, in cases where the multi-beam antenna device according to the present invention is mounted in a vehicle, it can realize a detection capability sensitive to a range of about 15 degrees in each of rightward and leftward directions with respect to 0 degree defined by a direction perpendicular to a frontward-rearward direction of the vehicle (i.e., it has an aperture angle of up to about 30 degrees as a total of the rightward and leftward angles).

In other words, the antenna device according to the present invention can obtain ideal electric power and phase distributions required for an in-vehicle antenna device or the like.

There is a conventional technique (the Patent Document 3) where lens design is performed under a condition of $\beta>\alpha$, instead of $\beta<\alpha$ as in the present invention. Just to make sure, the Patent Document 3 will be mentioned below. The invention described in the Patent Document 3 is an antenna device which comprise parallel plates having a plurality of input elements adapted to be excited individually so as to feed electric power, and a plurality of output elements adapted to extract the electric power; and a transmission line for connection with an array antenna comprised of a plurality of antenna elements and adapted to radiate electromagnetic waves to space, wherein a curve for arranging the output elements thereon, and a length of the transmission line, are set based on three focal points on a curve for arranging the input elements thereon, in such a manner that, when a given one of the input elements is excited, a beam is radiated in a direction at an angle corresponding to that of the given input port, and wherein a shape of the curve for arranging the input elements thereon is not a part of a circle.

As can be understood from the above, due to the lens design performed under the condition of $\beta>\alpha$ (see FIG. 2 in the Patent Document 3), the shape of the curve for arranging the input elements thereon is set so as not to become a part of a circle, which shows that this antenna device is designed based on a process totally different from the Rotman's design process.

Considering the invention described in the Patent Document 3, an application having a need to set $\beta$ (radiation angle on the side of the antenna elements) to be greater than a (beam angle on the side of the Rotman lens) would include a military radar operable to detect a wide angular range with a less phase error.

Thus, the antenna device according to the present invention and the antenna device described in the patent Document 3 are totally different from each other in terms of a configuration (lens shape) and a problem to be solved (object).

The Patent Document 4 filed by the applicant of this application will also be mentioned below. The Patent Document 4 describes a beam-scanning planar antenna excellent in thinning and simplification of an assembling process and capable of facilitating a reduction in size. The planar antenna comprises a connection module 104 for connection with a system, a Rotman lens module 103, and a beam-scan antenna module 102, which are laminated in this order, wherein the planar antenna is formed by laminating: a third ground conductor 13; a fourth dielectric 34; a Rotman lens substrate 62 having a Rotman lens pattern, a second connection section 52 and a third connection section 92; a third dielectric 33; a second ground conductor 12; a second dielectric 32; a feeder substrate 61 formed with a plurality of antenna groups each comprising a combination of a radiation element 50, a feeder line 40 and a first connection section 51; a first dielectric 31; and a first ground conductor 11, in this order.

Design of the Rotman lens of this beam-scanning planar antenna is performed under the condition of $\alpha=\beta$ as with the conventional technique, and the number of elements in the planar antenna described in the Patent Document 4 is less than the number of elements in the present invention, as can be understood from directivity characteristics in FIG. 2 of the Patent Document 4. Thus, if the aperture 2 Ln of the array antenna becomes larger due to an increase in the number of the antenna elements, it is necessary to increase the distance F between the input port and S2 in proportion to the aperture 2 Ln of the array antenna (5), which causes a problem of an increase in the size G of the Rotman lens, as mentioned above. Therefore, the present invention is intended to solve this problem, and provides a low-loss multi-beam antenna device capable of designing a Rotman lens to suppress an increase in loss so as to achieve enhanced gain.

(Feature of Present Invention from Perspective of Rotman Lens Design Flow)

One feature of the present invention is that the present invention makes it possible to design a Rotman lens under the condition of $\beta<\alpha$, using the aforementioned modified Rotman process based on the conventional Rotman lens design process. This modified Rotman process will be more specifically described based on the flowcharts illustrated in FIGS. 9A and 9B.

Figure 9A:
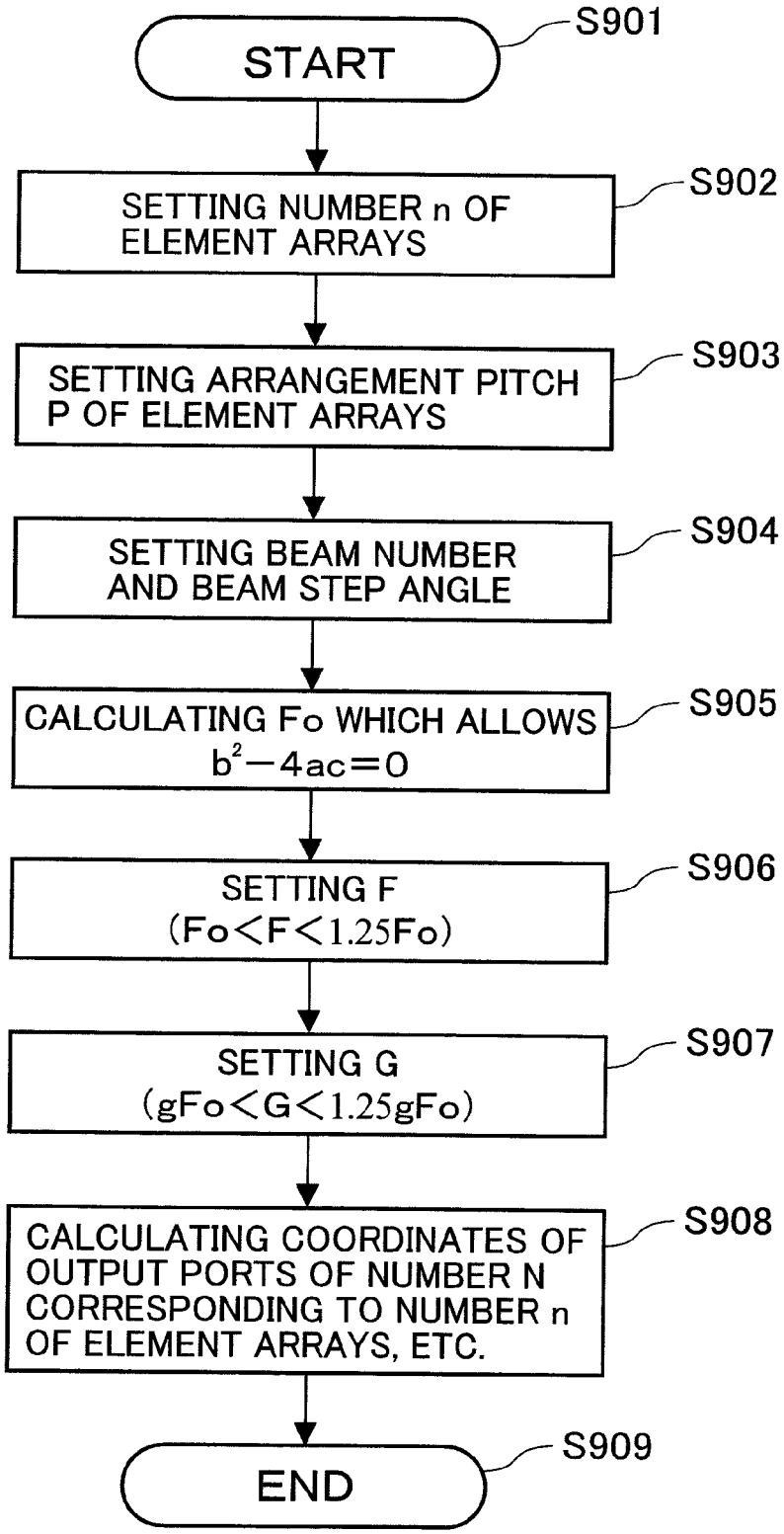
FIG. 9A is an explanatory diagram illustrating a design flow for a Rotman lens in the conventional multi-beam antenna device.
Figure 9B:
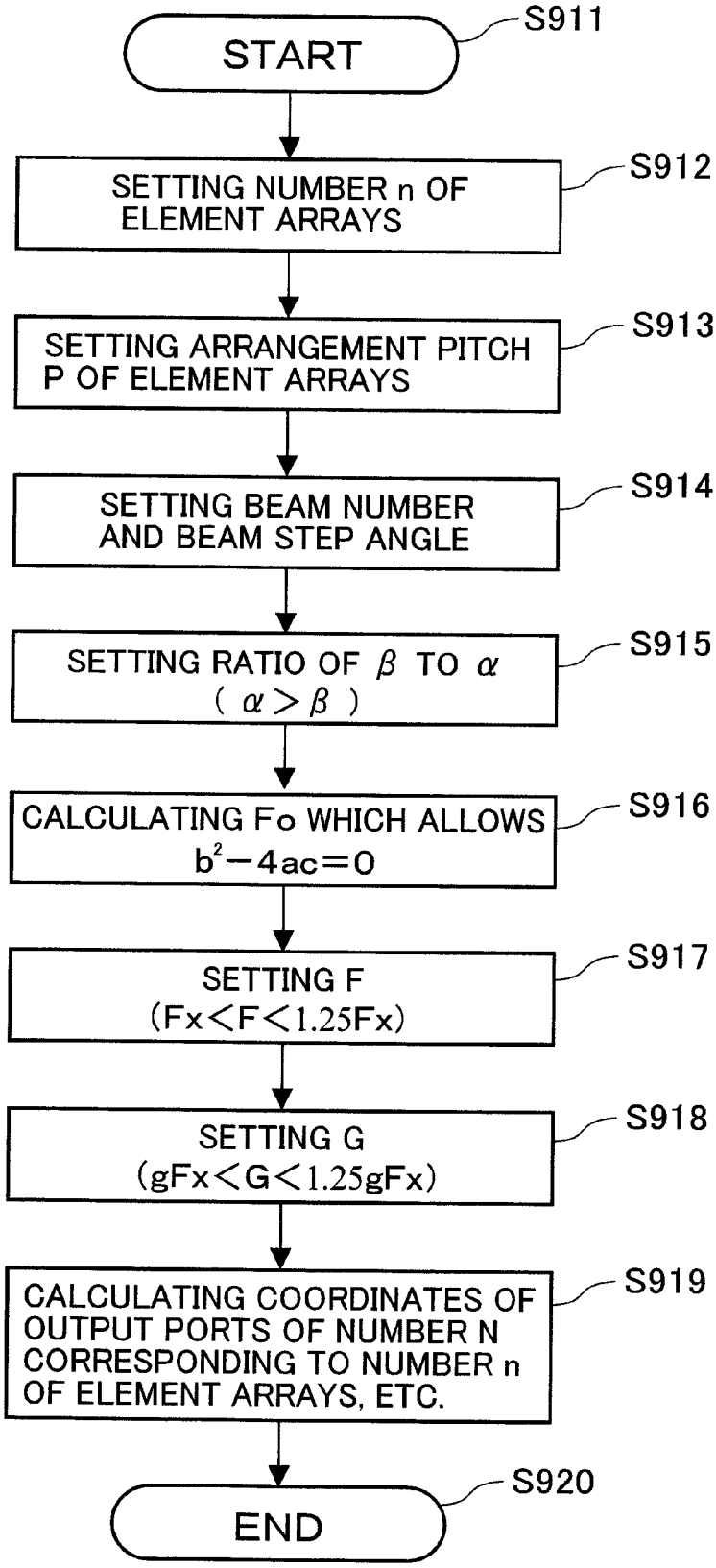
FIG. 9B is an explanatory diagram illustrating a design flow for a Rotman lens in a multi-beam antenna device according to the present invention.

FIG. 9A is a design flow based on the conventional Rotman process. Upon start of the design flow in S901, the process advances to S902, wherein a number n of antenna element arrays is set. Then, the process advances to S903, wherein an arrangement pitch P of the n antenna element arrays is set. Thus, the antenna aperture 2 Ln is expressed as follows: $2Ln=(n-1)P$. Then, the process advances to S904, wherein a beam number and a beam step angle are set. The beam number means the number of input ports. The beam step angle means an angular difference between the antenna beam angle $\beta$ and each of the input port Nos. (For example, in Table 1, the beam step angle is around about 4 degrees) Then, the process advances to S905, wherein $F_0$ which allows $b^2-4ac=0$ is calculated.

In the conventional Rotman process, the design is performed under the condition of $\alpha=0$, and thereby $F_0=Ln$. Further, $Fx=\beta\cdot F_0/1$. Thus, under the condition of $a>\beta$ as in the present invention, it is obvious that Fx becomes less than $F_0$ ($Fx<F_0$). Thus, under the condition of $\alpha=\beta$, in Fx, $\eta=Ln/F$ becomes less than 1 ($\eta=Ln/F\leq 1$). In this case, $b^2-4ac$ in the Formula 5 has a negative value, which means that the design fails.

Then, in S906, the distance F between the input port (21) and S2 is set. In this case, the distance F is set in the following range: $F_0<F<1.25\ F_0$. Then, the process advances to S907, wherein the lens size G is set. In this case, the size G is set in the following range: $g\ F_0<G<1.25\ g\ F_0$. Specifically, when the shape factor $g=G/F$ is set to a typical value of 1.136, the size G is set in the following range: $1.136\ F_0<G<1.4\ F_0$.

Then, in S908, respective coordinates (x, y) of the output ports of a number n corresponding to the number n of the element arrays, and a corrective line phase w in each of the output ports, are calculated.

FIG. 9A is a design flow based on the modified Rotman process in the present invention. A difference from FIG. 9A is that a ratio of $\beta$ to $\alpha$ can be set in S915, wherein the ratio can be set to satisfy the following relationship: $\alpha>\beta$. The ratio set in this manner is used as a coefficient or factor for $\eta$, as indicated in the Formula 6. Specifically, respective coordinates (x, y) of the ports are calculated while controlling each design parameter to satisfy the following relation:

$$\eta=(\beta/\alpha)\cdot(Ln/F)<1 \quad (6)$$

Based on the above difference, the design flow based on the modified Rotman process in the present invention is configured as follows. Upon start of the design flow in S911, the process advances to S912, wherein a number n of antenna element arrays is set. Then, the process advances to S913, wherein an arrangement pitch P of the n antenna element arrays is set. Then, the process advances to S914, wherein a beam number and a beam step angle are set. Then, in S915, a ratio of $\beta$ to $\alpha$ can be set to satisfy the following relationship: $\alpha>\beta$, as mentioned above. Then, the process advances to S916, wherein Fx which allows $b^2-4ac=0$ is calculated. Under the condition of $\alpha>\beta$, $Fx=\beta\cdot Ln/a$. Then, in S917, the distance F between the input port (21) and S2 is set. In this case, the distance F is set in the following range: $Fx<F<1.25\ Fx$. Then, the process advances to S918, wherein the lens size G is set. In this case, the size G is set in the following range: $g\ Fx<G<1.25\ g\ Fx$. Specifically, when the shape factor $g=G/F$ is set to a typical value of 1.136, the size G is set in the following range: $1.136\ Fx<G<1.4\ Fx$.

Then, in S919, respective coordinates (x, y) of the output ports of a number n corresponding to the number n of the element arrays, and a corrective line phase w in each of the output ports, are calculated.

(Supplementary Explanation about First and Second Embodiments)

The first and second embodiments have been described together with specific numerical values under the following condition represented by the Formula 6: $\eta=(\beta/\alpha)\cdot(Ln/F)<1$ (6). Some supplemental explanation will be added here. In a preferred embodiment, $\beta/\alpha$ is approximately in the following numerical range;

$$0.33\leq\beta/\alpha<1$$

An upper limit value, a standard value and a lower limit value of $\eta$ are assumed as follows.

(1) Upper Limit Value of $\eta$

An upper limit value of $\eta$ is assumed as $\eta=(\beta/\alpha)\cdot(Ln/F)\approx 1$. In this case, F is minimized (minimum value in a selection range of F).

(2) Standard Value of $\eta$

A standard value of $\eta$ is assumed as $\eta=(\beta/\alpha)\cdot(Ln/F)=0.88$. In this case, F is optimized (optimal value in the selection range of F).

(3) Lower Limit Value of $\eta$

A lower limit value of $\eta$ is assumed as $\eta=(\beta/\alpha)\cdot(Ln/F)\leq 0.5$ to 0.7. In this case, F is maximized (maximum value in the selection range of F).

An actual value of F measured when has an upper limit value, a standard value or a lower limit value, is expresses as multiples of wave length $\lambda$, and summarized in the following Table 2.

TABLE 2

| First Embodiment | | | | | |
|---|---|---|---|---|---|
| Ratio $\beta/\alpha$ | Number of Element Arrays | Arrangement Pitch | $\eta$: Upper Limit ($\eta\approx 1$) F min | $\eta$: Standard ($\eta=0.88$) F optimal | $\eta$: Lower Limit F max |
| 0.7 | 24 | 0.77$\lambda$ | 6.5$\lambda$ | 7$\lambda$ | 9$\lambda$ $\eta=0.67$ |
| 0.5 | 24 | 0.77$\lambda$ | 4.5$\lambda$ | 5$\lambda$ | 9$\lambda$ $\eta=0.5$ |
| 0.33 | 24 | 0.77$\lambda$ | 3$\lambda$ | 3.3$\lambda$ | 6$\lambda$ $\eta=0.5$ |

In the conventional process, $\eta=1$, and $\alpha=\beta$, wherein F is a minimum value, specifically, F has a length of 9$\lambda$. This shows that a value equal to or less than the wavelength in the conventional process can be obtained in any case in the above Table 2. In the Table 2.5$\lambda$, in the column of $\eta$=Standard is a measured value corresponding to the second embodiment.

2 Ln (=(n−1) P) means an aperture length of the array antenna (5), and indicates a distance between one (a central one) of the radiation elements (56) in one of the element arrays on one side of the antenna substrate (52), and one (a central one) of the radiation elements (56) in one of the element arrays on the other side of the antenna substrate (52).

The angle $\beta$ indicates an angle between a perpendicular line extending from the radiation element (56) toward the slotted plate, and a direction along which a beam is radiated from the radiation element.

In the present invention, in cases where a Rotman lens is designed from preset input port coordinates (x, y), and output port coordinates (x, y) calculated based on the Formulas 5, 6, etc., for example, when the connection portion of the input port is formed as two branched transmission lines, a preset position is two chevron-shaped input port joining points at respective distal ends of the two branched transmission lines. On the other hand, when the connection portion is not branched, the preset position is a center of an opening of a chevron-shaped counterpart input port. This concept for the preset position has heretofore been employed, and can be applied to the output ports in the same manner. Further, it can also be applied to the aftermentioned Table 3.

A level of reduction in G in the present invention as compared to G in the conventional technique will be described below.

$G_1$ in the present invention with respect to $G_0$ in the conventional technique can be technically achieved in the following range: $0.25\ G_0<G_1<0.80\ G_0$. Based on Table 2, the following range would be derived using the aforementioned Formulas: $0.33\ G_0<G_1<0.67\ G_0$. Further, it is noted that a significantly excellent result is actually obtained in the following range: $0.33\ G_0<G_1<0.5\ G_0$.

(Supplementary Explanation about Third Embodiment)

In the same way, an actual measurement result corresponding to the third embodiment is summarized in the following Table 3.

TABLE 3

| Third Embodiment | | | | | |
|---|---|---|---|---|---|
| Ratio β/α | Number of Element Arrays | Arrangement Pitch | η: Upper Limit (η ≈ 1) F min | η: Standard (η = 0.88) F optimal | η: Lower Limit F max |
| 0.7 | 16 | 0.77λ | 4.1λ | 4.5λ | 6λ η = 0.76 |
| 0.5 | 16 | 0.77λ | 2.9λ | 3.3λ | 6λ η = 0.5 |
| 0.33 | 16 | 0.77λ | 2λ | 2.2λ | 3.8λ η = 0.5 |

In the conventional process, η=1, and α=β, wherein F is a minimum value, specifically, F has a length of 9λ. This shows that a value equal to or less than the wavelength in the conventional process can be obtained in any case in the above Table 3.

(Supplementary Explanation about FIG. 2)

Figure 10:
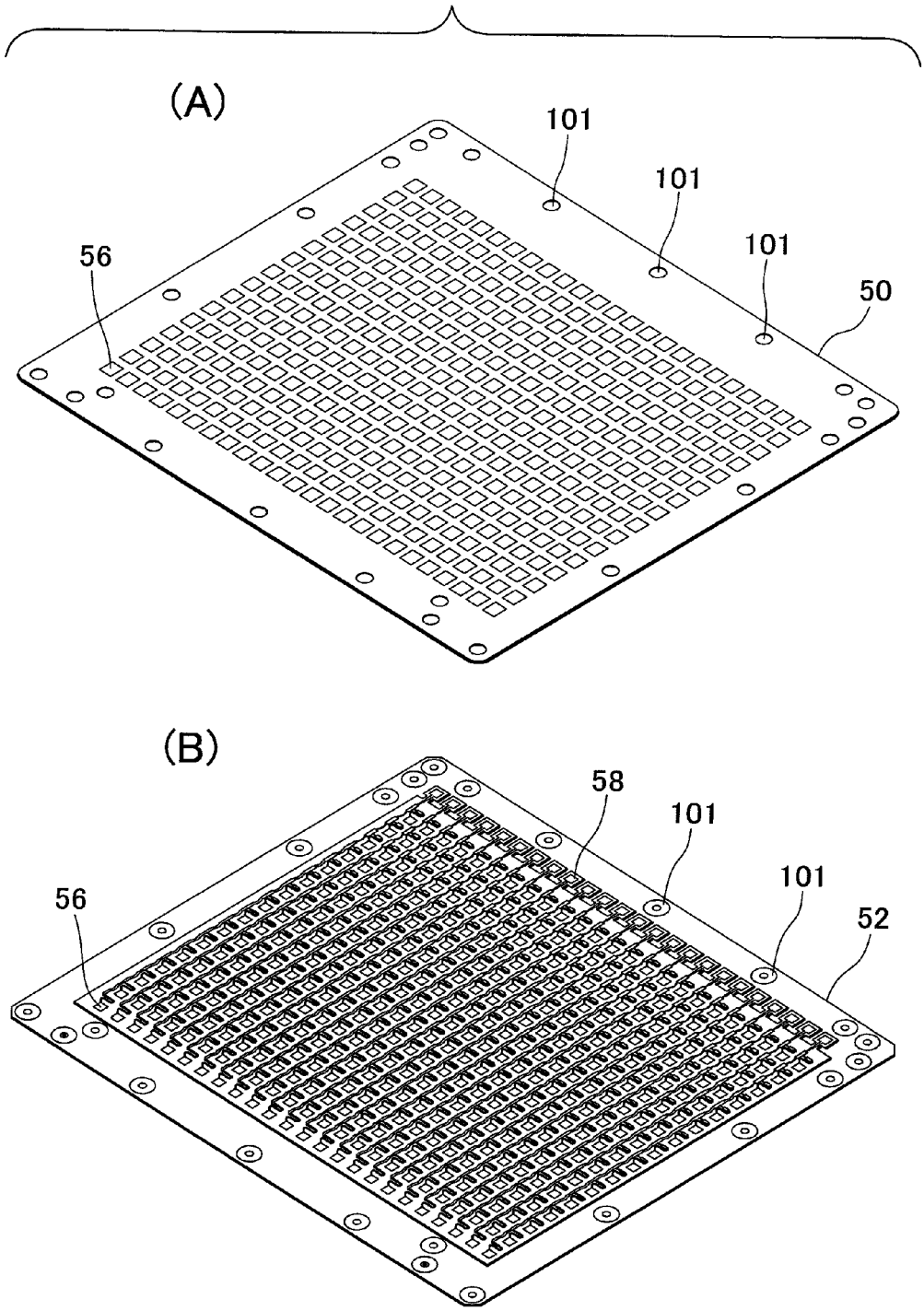
FIG. 10 is an explanatory diagram perspectively illustrating a part of the structure of the multi-beam antenna device according to the present invention illustrated in FIG. 2

The structure of the multi-beam antenna device according to the first embodiment illustrated in FIG. 2 will be supplementarily described below. Although respective structures of the slotted plate 50 and the antenna substrate 52 are clear only from FIG. 2, they are enlargedly illustrated in FIG. 10(A) and FIG. 10(B), respectively. In FIG. 10, the plurality of slots 54 are provided in the slotted plate 50 in lengthwise and widthwise directions. Each of the slots 54 is disposed at a position approximately corresponding to a position of a respective one of the radiation elements 56 in the antenna substrate 52. Further, the slotted plate 50 and the antenna substrate 52 are provided with respective ones of a pair of rivet holes 101 at positions alignable with each other when they are laminated together, and integrally riveted together with the aftermentioned other substrate, etc.

Figure 11:
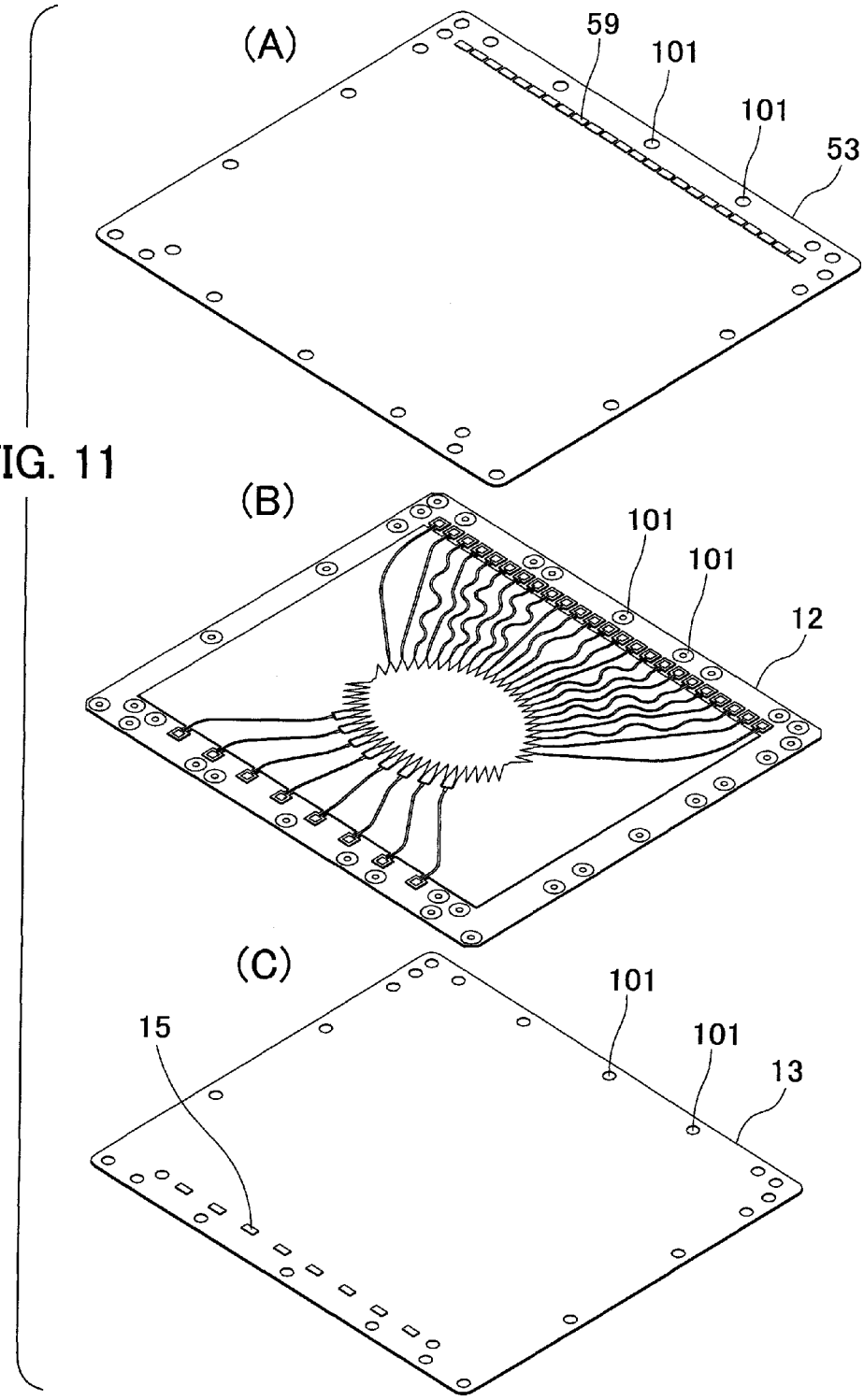
FIG. 11 is an explanatory diagram perspectively illustrating a part of the structure of the multi-beam antenna device according to the present invention illustrated in FIG. 2

The first ground conductor 53, the Rotman lens substrate and the second ground conductor are illustrated in FIG. 11(A), FIG. 11(B) and FIG. 11(C), respectively. In FIG. 11, the first connection hole 59 and a rivet hole 101 are provided in the first ground conductor 53. The second connection hole 15 and a rivet hole 101 are provided in the second ground conductor 13. The above rivet holes serve as a means to allow the substrates and others after being laminated together to be integrally riveted.

Figure 12:
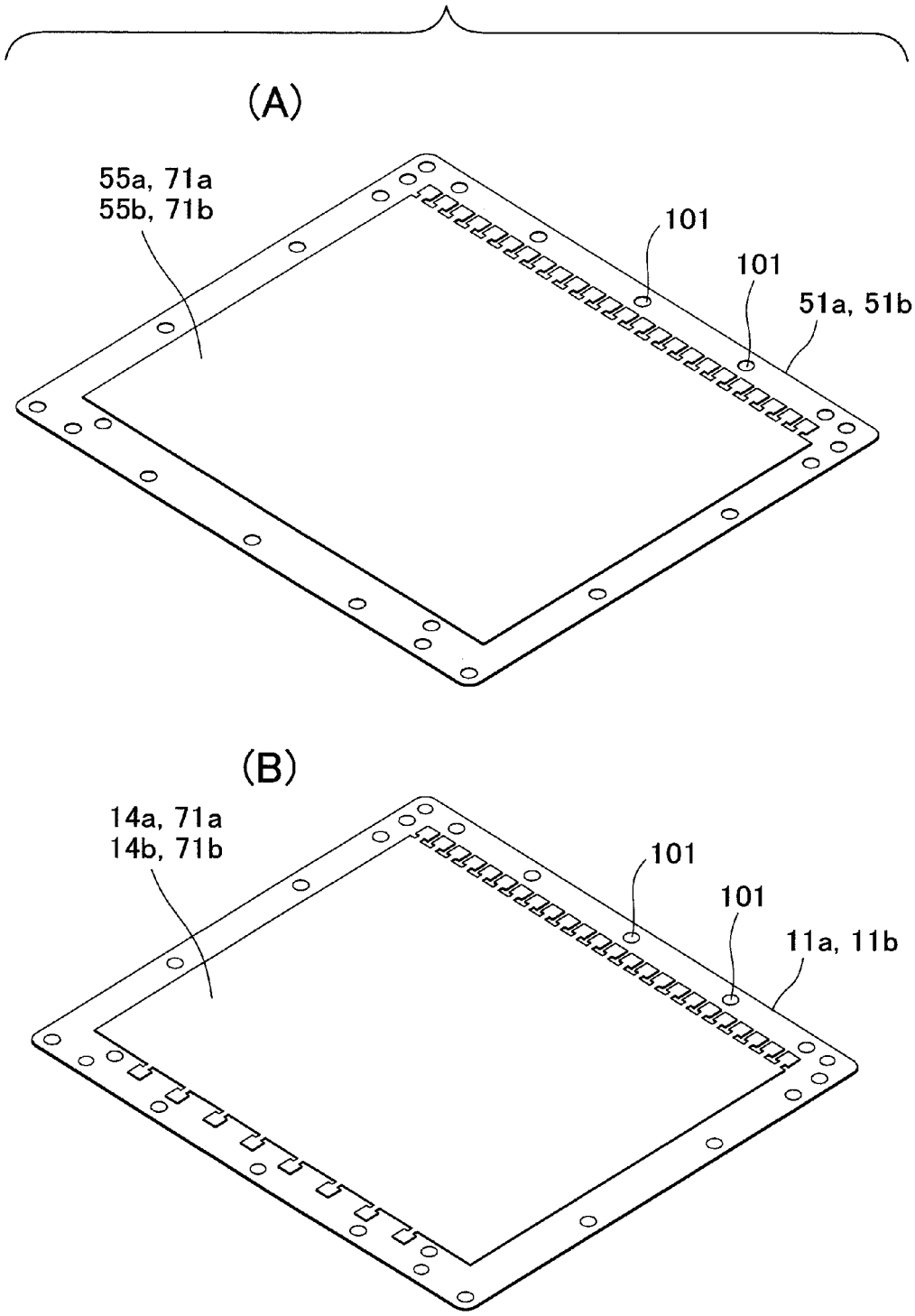
FIG. 12 is an explanatory diagram perspectively illustrating a part of the structure of the multi-beam antenna device according to the present invention illustrated in FIG. 2

The metal spacer (51*a*, 51*b*) and the metal spacer (11*a*, 11*b*) are illustrated in FIG. 12(A) and FIG. 12(B), respectively. An inside of each of the spacers is formed as the void (55*a*, 55*b*, 14*a*, 14*b*), or filled with the dielectric (71*a*, 71*b*). A rivet hole 101 provided in a peripheral portion of each of the spacers is disposed to be aligned with a rivet hole provided in other substrate or the like, when they are laminated together, to serve as a means to allow the substrates and others after being laminated together to be integrally riveted.

EXPLANATION OF CODES

1: Rotman lens
5: array antenna
7: transmission line section
8: center line of Rotman lens
9: auxiliary line for indicating position of input port
10: beam direction when viewed from a direction facing array antenna
11*a*, 11*b*: metal spacer
12: Rotman lens substrate
13: second ground conductor
14*a*, 14*b*: void
15: second connection hole
16: connection port sub-section of transmission line section
17: input port section of multi-beam antenna device
21, 22, - - - 2*m*: Rotman lens input port
31, 32, - - - 3*n*: Rotman lens output port
41, 42, - - - 4*n*: antenna element
50: slotted plate
51*a*, 51*b*: metal spacer
52: antenna substrate
53: first ground conductor
54: slot
55*a*, 55*b*: void
56: radiation element
57: feeder line
58: first connection section
59: first connection hole
61, 62, - - - 6*n*: transmission line connecting output port to antenna element
71*a*, 71*b*: substrate-supporting dielectric

The invention claimed is:

1. A multi-beam antenna device comprising: a Rotman lens having a plurality of input ports for feeding electric power, and a plurality of output ports for extracting the electric power from the input ports; an array antenna comprised of a plurality of antenna elements and adapted to radiate electromagnetic waves to space; and a plurality of transmission lines connecting respective ones of the output ports to respective ones of the antenna elements, wherein a curve for arranging the output ports thereon and a length of each of the transmission lines are set such that, when a given one of the input ports is excited, a beam is formed in a direction at an angle corresponding to that of the given input port, characterized in that:

β with respect to α is set to satisfy the following relation: $\beta<\alpha$, where: β is a spatial beam-forming angle of the array antenna when viewed from a direction facing a front of the array antenna; and α is an angle between a center line of the Rotman lens, and a line segment which connects one of the input ports and an intersecting point S2 of the center line with a curve segment having the output ports arranged thereon; and a shape of the Rotman lens is set to satisfy the following relation: $\eta=(\beta/\alpha)(Ln/F)<1$, and reduce G to less than a value of G when designed under a condition of $\beta=\alpha$, where: F is a distance between the one input port and S2; 2 Ln is an aperture length of the array antenna; and G is a size of the Rotman lens, and defined as a distance between S2 and S3 (wherein S3 is an intersecting point of the center line with a curve segment having the input ports arranged thereon); and 2 Ln is an aperture length of the array antenna.

2. The multi-beam antenna device as defined in claim 1, characterized in that the Rotman lens is formed using a triplate.

3. The multi-beam antenna device as defined in claim 2, characterized in that the array antenna is formed using a triplate.

4. The multi-beam antenna device as defined in claim 3, characterized in that each of the input ports is partially formed as two branched transmission lines to distribute and feed electric power.

5. The multi-beam antenna device as defined in claim 2, characterized in that each of the input ports is partially formed as two branched transmission lines to distribute and feed electric power.

6. The multi-beam antenna device as defined in claim 1, characterized in that each of the input ports is partially formed as two branched transmission lines to distribute and feed electric power.

7. A multi-beam antenna device comprising: a Rotman lens having a plurality of input ports for feeding electric power, and a plurality of output ports for extracting the electric power from the input ports; an array antenna comprised of a plurality of antenna elements and adapted to radiate electromagnetic waves to space; and a plurality of transmission lines connecting respective ones of the output ports to respective ones of the antenna elements, wherein a curve for arranging the output ports thereon and a length of each of the transmission lines are set such that, when a given one of the input ports is excited, a beam is formed in a direction at an angle corresponding to that of the given input port, characterized in that:

β with respect to α is set to satisfy the following relation: $\beta<\alpha$, where: β is a spatial beam-forming angle of the array antenna when viewed from a direction facing a front of the array antenna; and a is an angle between a center line of the Rotman lens, and a line segment which connects one of the input ports and an intersecting point S2 of the center line with a curve segment having the output ports arranged thereon; and a shape of the Rotman lens is set to reduce G to less than a value of G when designed under a condition of $\beta=\alpha$, where G is a size of the Rotman lens, and defined as a distance between S2 and S3 (wherein S3 is an intersecting point of the center line with a curve segment having the input ports arranged thereon).

8. The multi-beam antenna device as defined in claim 7, characterized in that the Rotman lens is formed using a triplate.

9. The multi-beam antenna device as defined in claim 8, characterized in that the array antenna is formed using a triplate.

10. The multi-beam antenna device as defined in claim 9, characterized in that each of the input ports is partially formed as two branched transmission lines to distribute and feed electric power.

11. The multi-beam antenna device as defined in claim 8, characterized in that each of the input ports is partially formed as two branched transmission lines to distribute and feed electric power.

12. The multi-beam antenna device as defined in claim 7, characterized in that each of the input ports is partially formed as two branched transmission lines to distribute and feed electric power.

13. A multi-beam antenna device comprising: a Rotman lens having a plurality of input ports for feeding electric power, and a plurality of output ports for extracting the electric power from the input ports; an array antenna comprised of a plurality of antenna elements and adapted to radiate electromagnetic waves to space; and a plurality of transmission lines connecting respective ones of the output ports to respective ones of the antenna elements, wherein a curve for arranging the output ports thereon and a length of each of the transmission lines are set such that, when a given one of the input ports is excited, a beam is formed in a direction at an angle corresponding to that of the given input port, characterized in that the Rotman lens is designed according to a design procedure comprising the steps of:

setting a number n of antenna element arrays;

setting an arrangement pitch P of the antenna element arrays;

setting a beam number and a beam step angle;

setting β with respect to α to satisfy the following relation: $\beta<\alpha$, where: β is a spatial beam-forming angle of the array antenna when viewed from a direction facing a front of the array antenna; and α is an angle between a center line of the Rotman lens, and a line segment which connects one of the input ports and an intersecting point S2 of the center line with a curve segment having the output ports arranged thereon;

calculating Fx which allows $b^2-4ac=0$;

setting a value of F;

setting a value of G; and calculating respective coordinates (x, y) of the output ports of a number N corresponding to the number n of the element arrays, and a corrective line phase w in each of the output ports, whereby a shape of the Rotman lens is set to reduce G to less than a value of G when designed under a condition of $\beta=\alpha$, where G is a size of the Rotman lens, and defined as a distance between S2 and S3 (wherein S3 is an intersecting point of the center line with a curve segment having the input ports arranged thereon), wherein $$a=1-\eta^2-[(g-1)/(g-a_0)]^2,$$

$$b=2g(g-1)/(g-a_0)-[(g-1)/(g-a_0)^2]b_0^2\eta^2+2\eta^2-2g, \text{ and}$$

$$c=gb_0^2\eta^2/(g-a_0)-b_0^4\eta_4/[4(g-a_0)^2]-\eta_2,$$

where $g=G/F$, $\eta=(\beta/\alpha)(Ln/F)$, $a_0=\cos\alpha$, and $b_0=\sin\alpha$.

14. An in-vehicle multi-beam antenna device comprising: a Rotman lens having a plurality of input ports for feeding electric power, and a plurality of output ports for extracting the electric power from the input ports; an array antenna comprised of a plurality of antenna elements and each adapted to radiate electromagnetic waves to space; and a plurality of transmission lines connecting respective ones of the output ports to respective ones of the antenna elements, wherein a curve for arranging the output ports thereon and a length of each of the transmission lines are set such that, when a given one of the input ports is excited, a beam is formed in a direction at an angle corresponding to that of the given input port, characterized in that $\beta$ with respect to $\alpha$ is set to satisfy the following relation: $\beta<\alpha$, where: $\beta$ is a spatial beam-forming angle of the array antenna when viewed from a direction facing a front of the array antenna; and $\alpha$ is an angle between a center line of the Rotman lens, and a line segment which connects one of the input ports and an intersecting point S2 of the center line with a curve segment having the output ports arranged thereon.

15. The in-vehicle multi-beam antenna device as defined in claim 14, characterized in that the Rotman lens is formed using a triplate.

16. The in-vehicle multi-beam antenna device as defined in claim 15, characterized in that the array antenna is formed using a triplate.

17. The multi-beam antenna device as defined in claim 16, characterized in that each of the input ports is partially formed as two branched transmission lines to distribute and feed electric power.

18. The multi-beam antenna device as defined in claim 15, characterized in that each of the input ports is partially formed as two branched transmission lines to distribute and feed electric power.

19. The multi-beam antenna device as defined in claim 14, characterized in that each of the input ports is partially formed as two branched transmission lines to distribute and feed electric power.

* * * * *